US007046918B1

(12) United States Patent
Burkett et al.

(10) Patent No.: US 7,046,918 B1
(45) Date of Patent: May 16, 2006

(54) SPACE HEATER WITH PRETREATED HEAT EXCHANGER

(75) Inventors: William W. Burkett, Galena, MO (US); Glenda Sue Burkett, Galena, MO (US)

(73) Assignee: MHE Corp., Reeds Spring, MO (US)

( * ) Notice: Subject to any disclaimer, the term of this patent is extended or adjusted under 35 U.S.C. 154(b) by 0 days.

(21) Appl. No.: 10/996,346

(22) Filed: Nov. 23, 2004

(51) Int. Cl.
*F24H 3/00* (2006.01)

(52) U.S. Cl. ..... 392/375; 392/503; 392/356; 126/110 R; 165/123; 165/179; 165/185

(58) Field of Classification Search ..... 392/375, 392/503, 356; 126/110 R; 165/123, 179, 165/185
See application file for complete search history.

(56) References Cited

U.S. PATENT DOCUMENTS

| | | | | |
|---|---|---|---|---|
| 1,006,767 | A | 10/1911 | Mauger | 392/410 |
| 1,534,571 | A | 4/1925 | Conning | 392/367 |
| 2,379,705 | A | 7/1945 | Graves | 392/356 |
| 2,527,013 | A | 10/1950 | Kjelgaard | 392/356 |
| 2,919,338 | A | 12/1959 | Covault et al. | 392/356 |
| 3,575,582 | A | 4/1971 | Covault | 392/356 |
| 3,777,728 | A | 12/1973 | Reiche | 123/549 |
| 4,052,593 | A | 10/1977 | Ebert | 219/521 |
| 4,164,642 | A | 8/1979 | Ebert | 219/358 |
| 4,197,447 | A | 4/1980 | Jones | 219/365 |
| 4,307,284 | A | 12/1981 | Perron | 219/342 |
| 4,309,594 | A | 1/1982 | Jones | 219/365 |
| 4,680,448 | A * | 7/1987 | Fester | 392/356 |
| 4,835,367 | A | 5/1989 | Hoffman | 219/377 |
| 4,900,898 | A * | 2/1990 | Kling | 392/503 |
| 5,013,893 | A | 5/1991 | Goessler et al. | 219/453 |
| 5,157,239 | A | 10/1992 | Kanaya et al. | 219/411 |
| 5,568,586 | A | 10/1996 | Junkel | 392/376 |
| 5,954,980 | A | 9/1999 | Westerberg et al. | 219/411 |
| 5,990,460 | A | 11/1999 | Petty et al. | 219/497 |
| 6,041,994 | A | 3/2000 | Hwang et al. | 228/4.5 |
| 6,297,481 | B1 | 10/2001 | Gordon | 219/406 |
| 6,327,427 | B1 | 12/2001 | Burkett | 392/369 |
| 6,745,758 | B1 | 6/2004 | Minidis | 126/55 |

FOREIGN PATENT DOCUMENTS

| | | |
|---|---|---|
| GB | 2283810 | 5/1995 |
| JP | 62-293029 | 12/1987 |
| JP | 10-253163 | 9/1998 |
| WO | 9210709 | 6/1992 |

* cited by examiner

*Primary Examiner*—Shawntina Fuqua
(74) *Attorney, Agent, or Firm*—Grace J. Fishel

(57) ABSTRACT

A space heater with a linear source of infrared radiant energy in heat exchange relationship with a heat exchanger formed of copper or aluminum material. The copper is pretreated to soften the copper and partially blacken the surface thereof. The aluminum is anodized and electrolytically colored dark. The space heater is thermally more efficient than a comparable space heater wherein the copper or aluminum has not been pretreated. The linear source of infrared radiant energy and heat exchanger are mounted in a heater core that is thermally insulated by an air jacket from an exterior case.

12 Claims, 5 Drawing Sheets

SPACE HEATER WITH PRETREATED HEAT EXCHANGER

BACKGROUND OF THE INVENTION

1. Field of the Invention

The present invention relates to a space heater which generates heat by passing an electrical current through a linear source of infrared radiant energy in heat exchange relationship with a pretreated copper or aluminum heat exchanger.

2. Brief Description of the Prior Art

With the dwindling supply of fossil fuels and their associated spiraling costs, more homes and businesses are using space heaters as their primary or secondary heating source. After safety, the most important feature to be looked for in a space heater is thermal efficiency. Inefficient systems, such as found in the prior art, require the use of excess amounts of energy, thus increasing the cost of operation.

BRIEF SUMMARY OF THE INVENTION

In view of the above, it is an object of the present invention to provide a more heat efficient space heater. Other objects and features of the invention will be in part apparent and in part pointed out hereinafter.

A space heater in accordance with the present invention has a heater core with one or more linear sources of infrared energy, preferably horizontally mounted. A heat exchanger formed of copper or aluminum is mounted in the heater core. The heat exchanger is preferably a cylinder mounted around one or more of the linear sources of infrared energy.

When the cylinder is formed of copper, the copper is pretreated at a temperature and for a time sufficient to soften the copper and to partially blacken the surface thereof. The absorptivity and emissivity of the cylinder as a heat exchanger is improved thereby improving the thermal efficiency of the space heater. When the cylinder is formed of aluminum, the aluminum is anodized and electrolytically colored or dyed dark on the inside surface.

In a preferred embodiment, the heater core is mounted on a heater core support within an exterior case. An air jacket is provided between the heater core and the exterior case such that the exterior case is thermally insulated.

Cold air flows through an air inlet in the exterior case through the heater core such that it passes between the one or more linear sources of infrared energy and the inside of the cylinder. Flow is reversed such that the air passes along the outside of the cylinder. Heated air then exits through an air outlet in the exterior case.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
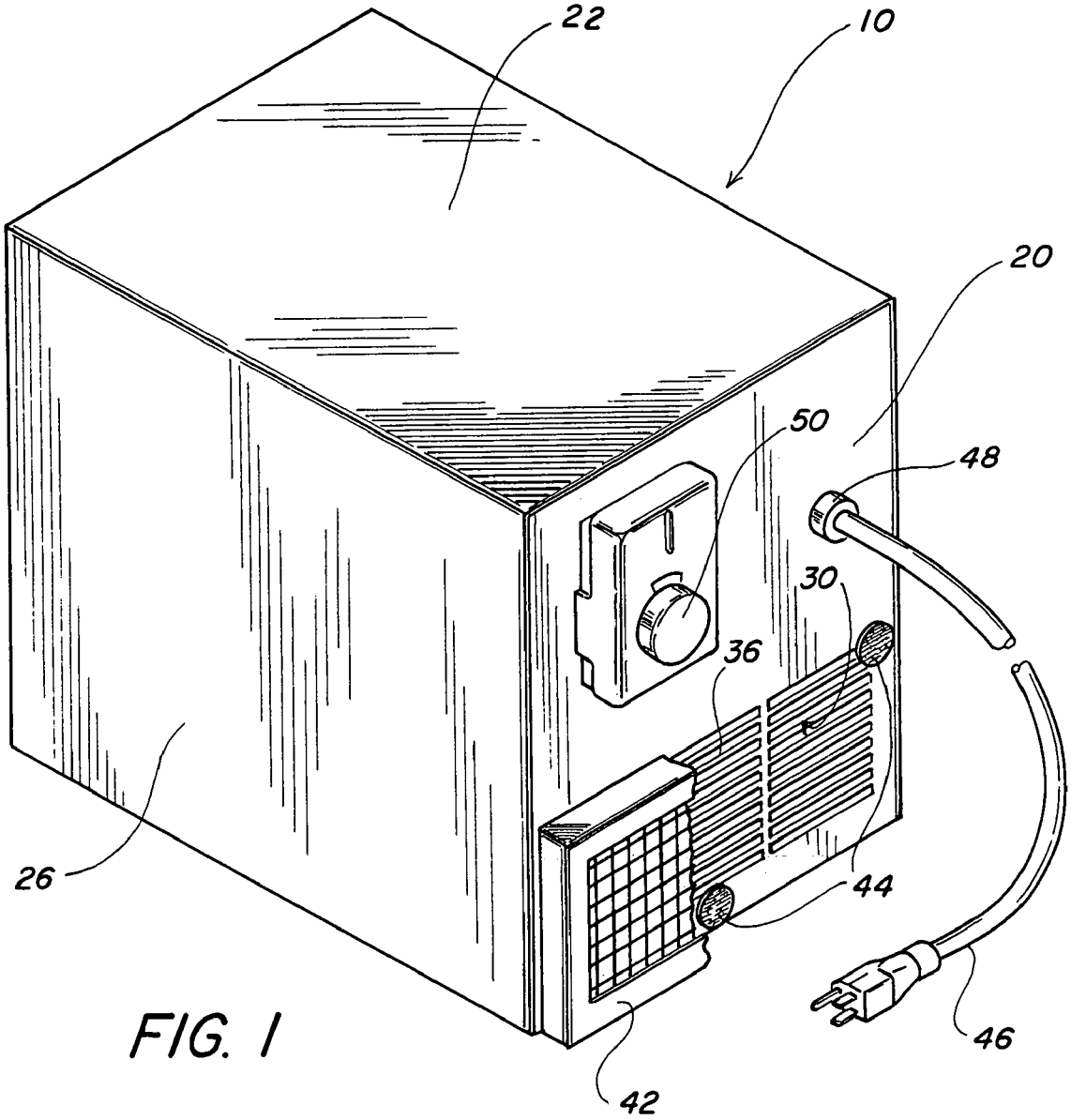
FIG. 1 is a perspective view of the exterior case of a space heater in accordance with the present invention.
Figure 2:
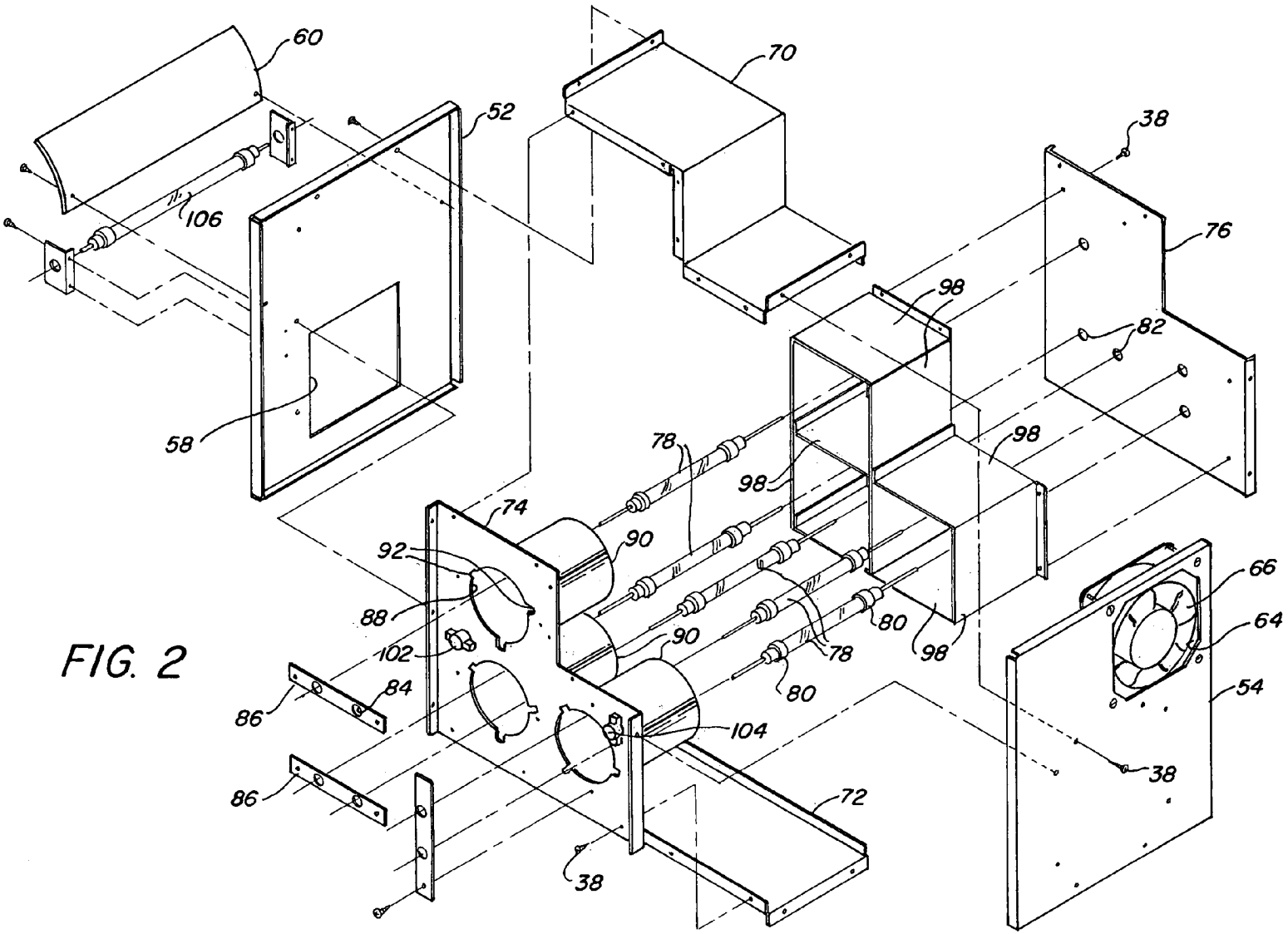
FIG. 2 is a perspective, exploded view of a heater core support and a heater core for the space heater.
Figure 3:
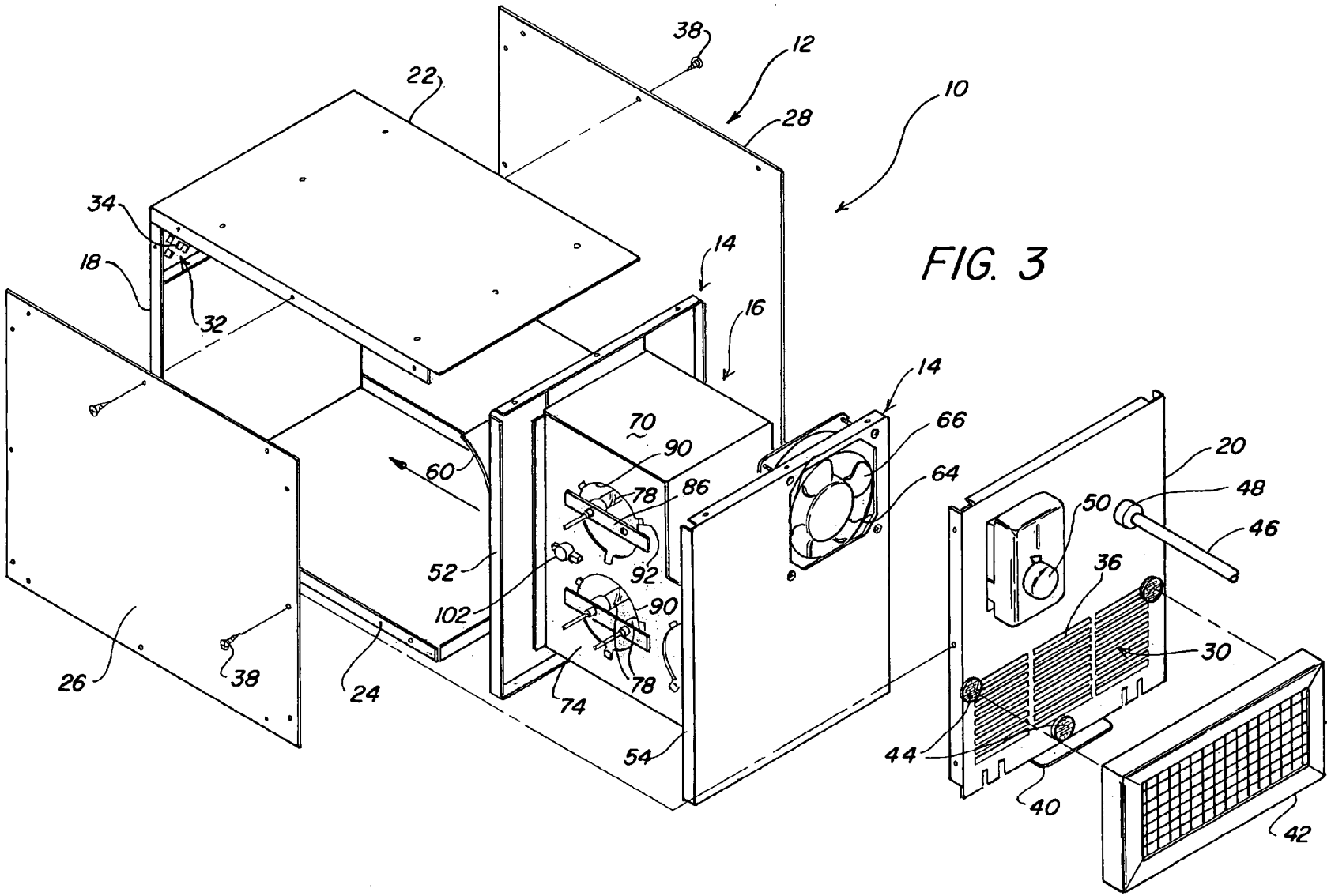
FIG. 3 is a perspective, exploded view of the exterior case and an assembled view of the heater core support and heater core for the space heater.
Figure 4:
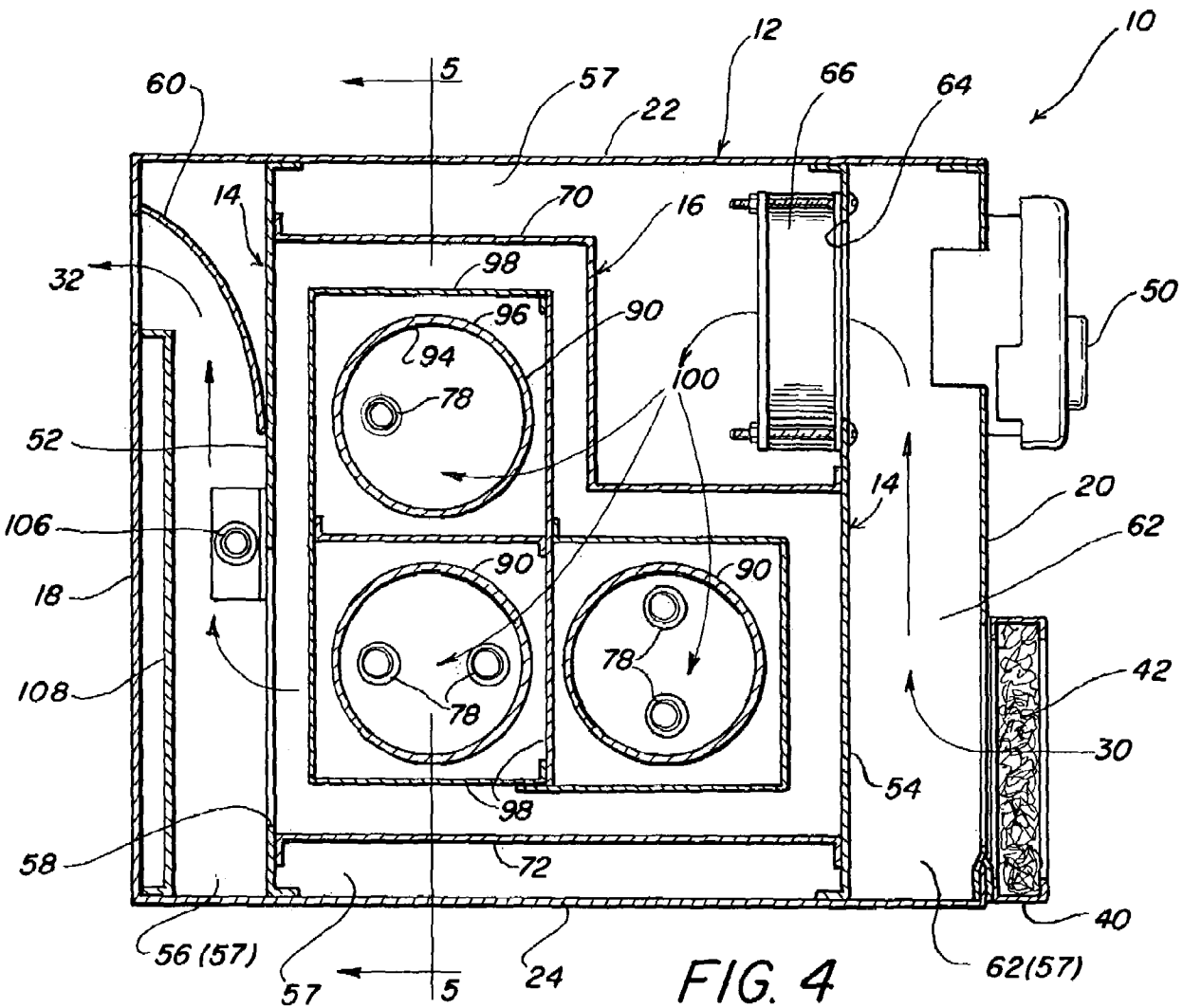
FIG. 4 is a cross-section of the space heater taken along the plane of 4—4 in FIG. 5; and, FIG. 5 is a cross-section of the space heater taken along the plane of 5—5 in FIG. 4.
Figure 5:
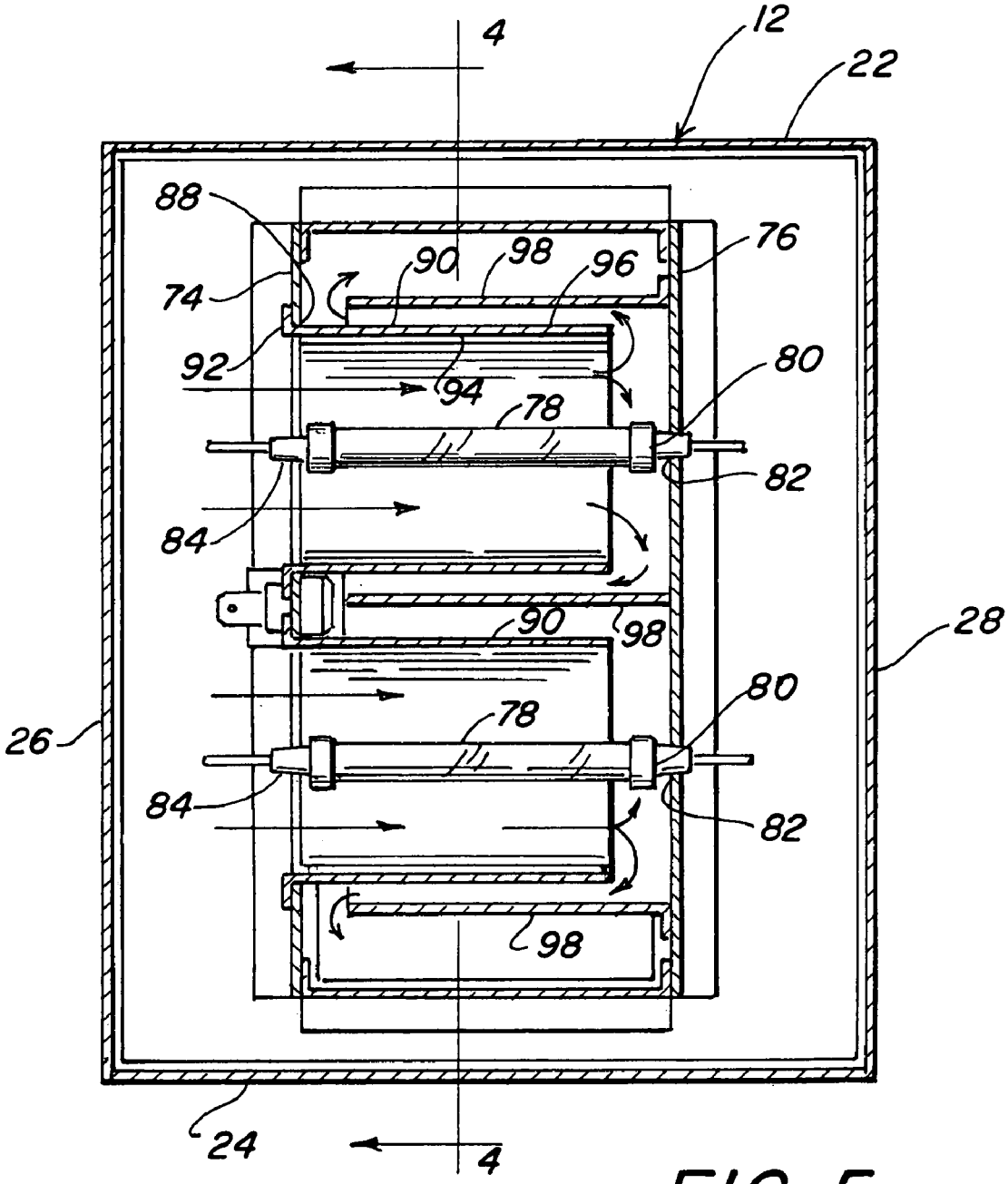

Referring to the drawings more particularly by reference character, reference numeral 10 refers to a space heater in accordance with the present invention. Space heater 10 comprises an exterior case 12, a heater core support 14 mounted inside exterior case 12 and a heater core 16 supported by heater core support 14.

Exterior case 12 is a box-like structure including a front wall 18, a rear wall 20, a top wall 22, a bottom wall 24 and side walls 26, 28. An air inlet 30 is provided in rear wall 20 and an air outlet 32 is provided in front wall 18. Air inlet 30 and air outlet 32 are covered with protective grilles 34, 36, respectively. As illustrated in the drawings, front wall 18 and top and bottom walls 22, 24 may be integrally formed as a wrapper to which side walls 26, 28 are joined with sheet metal screws 38 or by other conventional methods of construction such as welding, brazing and the use of fasteners, or combinations of methods as is known in the art. Rear wall 20 has an outwardly projecting toe 40 upon which may be mounted a filter 42 positioned over air inlet 30. Filter 42 may be attached to rear wall 20 with male and female mating fasteners 44 such as sold under the trademark VELCRO. Filter 42 may be of conventional construction, for example fiberglass or equivalent material as is commonly used in furnace filters. It is preferred, however, that filter 42 be a POLYTRON filter or equivalent.

A conventional power cord 46 extends from rear wall 20 for connecting the electrical components within exterior case 12 to a conventional 110 volt a.c. line. If desired, space heater 10 may have a power cord strain relief 48 installed in the hole through which power cord 46 passes. A variable thermostatic control 50 is also mounted on rear wall 20. Thermostatic control 50 communicates with the interior of space heater 10 through an opening provided in rear wall 20. An on-off switch (not shown) may be provided on front wall 18 or rear wall 20, if desired.

Exterior case 12 encloses heater core support 14. Heater core support 14 comprises a front mounting panel 52 and a rear mounting panel 54 such that heater core 16 is surrounded by an air jacket 57. Front mounting panel 52 is secured to top wall 22, bottom wall 24 and side walls 26, 28 and spaced a distance from front wall 18. The space between front mounting panel 52 and front wall 18 of exterior case 12 forms an exhaust chamber 56 which is part of an air jacket 57. An aperture 58 is provided in front mounting panel 52 above which is mounted a deflector shield 60 for directing air towards air outlet 32. In similar fashion, rear mounting panel 54 is secured to top wall 22, bottom wall 24 and side walls 26, 28 and spaced a distance from rear wall 20. The space between rear mounting panel 54 and rear wall 20 of exterior case 12 forms an intake chamber 62, which like exhaust chamber 56 is part of air jacket 57. An aperture 64 is provided in rear mounting panel 54 into which is mounted a fan 66 for inducting air into space heater 10 though air inlet 30 in rear wall 20 and forcing air out through air outlet 32.

Heater core 16 is supported by front mounting panel 52 and rear mounting panel 54 a distance below top wall 22 and above bottom wall 24 of exterior case 12 and a distance from side walls 26, 28. This spacing of heater core 16 from exterior case 12 completes air jacket 57. Air jacket 57 insulates exterior case 12 and prevents overheating. As such, it is possible for space heater 10 to be safely operated with exterior case 12 fitted into a wood cabinet.

Heater core 16 comprises a top wall 70, a bottom wall 72 and side walls 74, 76 and is mounted upon front mounting panel 52 and rear mounting panel 54, those panels forming the end walls of the heater core. At least one linear source of infrared radiant energy 78 is mounted between side walls 74, 76. In space heater 10 shown in the drawings, mountings for three pairs of radiant heaters 78 are provided with the radiant heaters mounted horizontally. Horizontal mounting of radiant heaters 78 is optimal as this arrangement increases residence time of the air passing through space heater 10 by obviating the chimney effect resulting from vertical mounting.

Each linear source of infrared radiant energy 78 comprises a high resistance wire wrapped in a helical configuration. The helically configured element is suspended within a quartz tube. The tube is capped with ceramic end pieces or caps 80 by means of which radiant heater 78 may be mounted in a hole 82 provided in side wall 76 and a hole 84 provided in a support bracket 86 bridging apertures 88 provided in side wall 74. Electrically conductive wires pass through holes 82, 84 for energizing radiant heater 78. The tube may be vacuum sealed and may contain an inert gas. The quartz tube may be clear, semi-translucent or translucent. In a preferred embodiment linear source of infrared radiant energy 78 has a clear quartz tube. In a commercial embodiment, each of five radiant heaters 78 is 250 watt.

A heat exchanger 90 in the form of a sheet of pretreated copper or aluminum fashioned into a cylinder is mounted around each of linear source of infrared radiant energy 78. Mounting tabs 92 are provided on one end of cylinder 90 for attachment of cylinder 90 in aperture 88. Cylinder 90 is shorter than the spacing between side walls 74, 76 of heater core 16 so that there is a gap between a free end of cylinder 90 and side wall 76. Each cylinder 90 has a first or inside surface 94 facing radiant heater 78 and a second or outside surface 96.

Divider panels 98 are provided for partitioning the inside of heater core 16 such that each cylinder 90 is in a separate compartment. Divider panels 98 are mounted on side wall 76 and are shorter than the spacing between side walls 74, 76 of heater core 16 so that there is gap between a free end of divider panels 98 and side wall 74. In the embodiment illustrated in the drawings, divider panels 98 with side wall 76 form three heating chambers 100.

When heat exchanger 90 is formed of copper material, the copper is pretreated at temperature and for a time sufficient to soften the copper material and to partially blacken the surface of the copper material. In a commercial embodiment, cylinder 90 is formed from sheet copper having a thickness of 0.0216 inch and an oxygen content of 0.028% by weight. Cylinder 90 is heated in an oven under ambient conditions for several hours at a temperature from about 850° F. to about 900° F. Any loose blackened material is removed by dry brushing inside surface 94 and outside surface 96 of cylinder 90. Mounting tabs 92 are bent over and cylinder 90 installed in apertures 88 and attached to side wall 74 as described above. Good results have been obtained when cylinder 90 is heated for two hours at a temperature between about 850° F. and 875° F. After which, cylinder 90 is dry brushed and then further heated for one hour at 425°. It is believed that equally good results are obtained when cylinder 90 is heated for three hours at 875° F. and then dry brushed to remove any loose particles. Removal of loose particles prevents them from being swept out air outlet 32 when space heater 10 is first operated. Pretreatment of the copper improves the heat efficiency of space heater 10 by increasing the absorptivity and emissivity of cylinder 90 and roughening inside and outside surfaces 94, 96 for more turbulent air flow.

When cylinder 90 is formed of aluminum material, the aluminum is pretreated by anodizing. During the anodizing process, a clear film of aluminum oxide is laid down on the aluminum's surface. For use in space heater 10, inside surface 94 of cylinder 90 is electrolytically colored a dark color to improve the material's radiant-heat properties, i.e., absorptivity and emissivity. It will be understood that outside surface 96 may also be electrolytically colored.

In a commercial embodiment of space heater 10, a pair of high temperature limit switches 102, 104 are provided in heater core 16. First switch 102 is located in heater core 16 close to front mounting panel 52 where air exits heater core 16 and is a fan control switch. When the temperature in heater core 16 rises above 110° F., fan 66 is switched on. Delayed starting of fan 66 is preferred such that cold air is not forced through air outlet 32. First switch 102 acts in reverse at the end of a heating cycle when space heater 10 is shut off. Fan 66 continues to operate until the temperature drops below 110° F., improving the efficiency of space heater 10 by extracting residual heat. Second switch 104 is located in heater core 16 close to fan 66 and is a safety switch. When the temperature in heater core 16 rises above 225° F., space heater 10 is shut down as a safety feature while first switch 102 keeps fan 66 running until the temperature in heater core 16 falls below 110° F. It will be apparent that the temperatures at which switches 102, 104 operate are arbitrary and a manner of design choice. Other switches 102, 104 may be used that are triggered at different temperature levels.

An auxiliary linear source of infrared radiant energy 106 may be mounted between front wall 18 of exterior case 12 and front mounting panel 52 below air outlet 32. If this additional source of radiant energy is provided, a heat deflector panel 108 may be added to front wall 18 to provide a dead air space insulating front wall 18 from overheating. In addition, deflector shield 60 may be made of untreated copper and serve as a heat exchanger, absorbing energy from auxiliary linear source of infrared radiant energy 106. The auxiliary linear source of infrared radiant energy 106 boosts the temperature of the air passing out of space heater 10 through air outlet 32. In addition, radiation from auxiliary radiant heater 106 is reflected by copper deflector shield 60 to provides a comforting warm glow seen through grille 34 over air outlet 32. It should be understood that deflector shield 60 may also be formed of pretreated copper or aluminum but the glow through grille 34 may be somewhat compromised. In a commercial embodiment of space heater 10, auxiliary linear source of infrared radiant energy 106 is a 250 watt quartz heating tube. Auxiliary radiant heater 106 with the five radiant heaters 78 in heater core 17 have a combined total wattage of 1500 and draw about 12.5 amps such that space heater 10 operates on 110 volt a.c. power.

In operation, thermostat control 50 switches on radiant heaters 78 and auxiliary radiant heater 106, when present, whenever the temperature within the environment monitored by the thermostat drops below a predetermined minimum. Power is also supplied to fan 66 causing the fan to be activated. When high temperature limit switch 102 is provided, activation of fan 66 may be delayed until the temperature in heater core 16 has risen to a selected temperature. This is done so that the air coming from space heater 10 is warm on startup.

Upon being energized, radiant heaters 78 emit heat rays which are absorbed and reemitted by cylinders 90. Cylinders 90 are thereby heated. Activation of fan 66 causes air to be circulated through space heater 10. The circulating air is initially forced into intake chamber 62 through air inlet 30. From intake chamber 62, it is pulled through aperture 64 in rear mounting panel 54 into that portion of air jacket 57 between heater core 16 and exterior case 12. Air jacket 57 forms a plenum from which air is forced through cylinders 90 passing over radiant heaters 78 and inside surface 94 of cylinders 90. Upon reaching side wall 76 of heater core 16, the air is deflected back along outside surface 96 of cylinder 90. As the air passes through heating chambers 100, the air is heated by radiant energy from radiant heaters 78 and by energy reemitted by cylinders 90 before it exits through the gap between the ends of divider panels 98 and side wall 74.

Heated air coming through aperture 58 in front mounting panel 52 passes into exhaust chamber 56 where it may be further heated by auxiliary radiant heater 106 before exiting through air outlet 32. Deflector shield 60 in addition to reflecting radiation from auxiliary radiant heater 106 such that a glow is seen through grille 34 and serving as a heat exchanger, also channels the flow of air such that it exits horizontally through air outlet 32. Air directed in this manner has a better chance of mingling with ambient air such that there is a more uniform dispersion of heat and less air temperature stratification between floor and ceiling level.

Once the monitored temperature rises above the preselected minimum, thermostatic control 50 switches radiant heaters 78 and auxiliary heater 106, when present, off. High temperature limit switch 102 continues to operate fan 66 until the air passing through heater core 16 falls below a preselected level thus completing a heating cycle.

A single space heater 10 in accordance with the present invention that is commercially available can effectively heat up to 800 square feet and is capable of safely increasing the temperature of the air drawn through the unit by approximately 120° F. Thermal efficiency of space heater 10 is effected by pretreatment of copper cylinders 90. In the commercial embodiment described above, space heater 10 is 9% more thermally efficient than a space heater wherein the copper cylinders have not been pretreated. This improvement results in 9% more heat from the same amount of power used. Other efficiencies result from stripping residual heat from heater core 16 on shut down with high temperature limit switch 102 and from the horizontal and serpentine passage of the air through cylinders 90 and then back along cylinders 90 increases the dwell time of the air in heater core 16. It will be apparent that other design features discussed above also contribute to the space heater's thermal efficiency.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A space heater comprising an exterior case and a heater core mounted inside the exterior case, said exterior case having an air inlet for ambient air and an air outlet for heated air, said heater core having a fan communicating with the air inlet and the air outlet for moving air through the heater core, at least one linear source of infrared radiant energy and a heat exchanger mounted in the heater core, said heat exchanger having first and second sides, said first side facing and surrounding said at least one linear source of infrared radiant energy, said heat exchanger being formed of copper material pretreated at a temperature and for a time sufficient to soften the copper material and to partially blacken the surface of the copper, said space heater further having an air passageway defining a path of air movement from the air inlet, along the length of at least one linear source of infrared radiant energy and along the length of the first side of the heat exchanger and out the air outlet.

2. The space heater of claim 1 wherein the air passageway further includes passing the air over the second side of the heat exchanger before passing out the air outlet.

3. A space heater comprising an exterior case, a heater core support mounted inside the exterior case, and a heater core supported by the heater core support, said exterior case having top, bottom, front, rear and side walls and an air inlet for ambient air in the rear wall and an air outlet for heated air in the front wall, said heater core support comprising a front mounting panel secured to the top, bottom and side walls of the exterior case and spaced a distance from the front wall forming an exhaust chamber, said front mounting panel having an aperture flowably connecting the heater core to the exhaust chamber, said heater core support further comprising a rear mounting panel secured to the top, bottom and side walls of the exterior case and spaced a distance from the rear wall forming an intake chamber, said rear mounting panel having an aperture flowably connecting the heater core to the intake chamber and a fan mounted in the aperture;

said heater core having at least one linear source of infrared radiant energy and a heat exchanger mounted in the heater core, said heat exchanger formed of copper material and having first and second sides, said first side facing said at least one linear source of infrared radiant energy, said heat exchanger being pretreated at a temperature and for a time sufficient to soften the copper material and to partially blacken the surface of the copper, said space heater further comprising an air passageway defining a path of air movement from the air inlet through the intake chamber, over the at least one linear source of infrared radiant energy and along the first side of the heat exchanger and through the exhaust chamber to the air outlet.

4. The space heater of claim 3 wherein the heat exchanger is formed of copper sheet and is heated under ambient conditions at a temperature between about 850° F. to about 900° F. for about 2 to 3 hours and then brushed to remove loose particles.

5. The space heater of claim 3 wherein the linear source of infrared radiant energy is mounted horizontally in the heater core.

6. A space heater comprising an exterior case, a heater core support mounted inside the exterior case, and a heater core supported by the heater core support, said exterior case having top, bottom, front, rear and side walls and an air inlet for ambient air in the rear wall and an air outlet for heated air in the front wall, said heater core support comprising a front mounting panel secured to the top, bottom and side walls of the exterior case and spaced a distance from the front wall forming an exhaust chamber, said front mounting panel having an aperture flowably connected to the exhaust chamber, said heater core support further comprising a rear mounting panel secured to the top, bottom and side walls of the exterior case and spaced a distance from the rear wall forming an intake chamber, said rear mounting panel having an aperture flowably connected to the intake chamber and a fan mounted in the aperture;

said heater core having a plurality of heating chambers, a copper cylinder and at least one linear infrared radiant heater mounted in each heating chamber, each copper cylinder having first and second sides, said first side facing the one or more of said linear infrared radiant heaters in said heating chamber, said copper cylinders being pretreated at a temperature and for a time sufficient to soften the copper material and to partially blacken the surface of the copper; and said space heater further comprising an air passageway defining a path of air movement passing sequentially from the air inlet through the intake chamber to the heater core, passing in the heater core over the infrared radiant heaters and the first side of the copper cylinder and over the second side of the copper cylinder in each heating chamber to the exhaust chamber, passing from the exhaust chamber out the air outlet.

7. The space heater of claim 6 wherein each copper cylinder is formed of copper sheet and is heated under ambient conditions at a temperature between about 850° F. to about 900° F. for about 2 to 3 hours and then brushed to remove loose particles.

8. The space heater of claim 7 wherein each linear infrared radiant heater is mounted horizontally in the heater core.

9. The space heater of claim 7 wherein the copper sheet is about 0.02 inches thick and has an oxygen content of about 0.028% percent by weight.

10. The space heater of claim 6 wherein the heater core has top and bottom walls spaced respectively from the top and bottom walls of the exterior case and side walls spaced respectively from the side walls of the exterior case forming an air jacket that with inlet chamber and outlet chamber insulates the exterior case from overheating.

11. The space heater of claim 10 further comprising a high temperature limit switch in the heater core that activates the fan when the temperature in the heater core has risen to a selected temperature.

12. The space heater of claim 11 wherein the high temperature limit switch continues operation of the fan until the temperature in the heater core has fallen below the selected temperature.

* * * * *